US011278132B2

(12) United States Patent
Spiro et al.

(10) Patent No.: US 11,278,132 B2
(45) Date of Patent: Mar. 22, 2022

(54) CUBE SHAPED DISPLAY ARTICLE

(71) Applicant: Tracer Imaging LLC, Ossining, NY (US)

(72) Inventors: Steven M. Spiro, Chappaqua, NY (US); Ryan Kelly, Ossining, NY (US); Paul Dowd, Scarsdale, NY (US)

(73) Assignee: TRACER IMAGING LLC, Ossining, NY (US)

( * ) Notice: Subject to any disclaimer, the term of this patent is extended or adjusted under 35 U.S.C. 154(b) by 0 days.

(21) Appl. No.: 17/083,609

(22) Filed: Oct. 29, 2020

(65) Prior Publication Data

US 2021/0120982 A1 Apr. 29, 2021

Related U.S. Application Data

(60) Provisional application No. 62/927,497, filed on Oct. 29, 2019.

(51) Int. Cl.
*A47G 1/06* (2006.01)
*A47G 1/14* (2006.01)

(52) U.S. Cl.
CPC ..... *A47G 1/065* (2013.01); *A47G 1/14* (2013.01); *A47G 2001/145* (2013.01)

(58) Field of Classification Search
CPC ..... A47G 1/065; A47G 1/14; A47G 2001/145
See application file for complete search history.

(56) References Cited

U.S. PATENT DOCUMENTS 3,235,118 A 2/1966 Kewley
3,716,936 A * 2/1973 Miller ..... A47G 1/14 40/720
3,771,246 A * 11/1973 Ebner ..... A47G 1/14 40/720
3,774,332 A * 11/1973 Schneider ..... G09F 1/12 40/720
4,854,060 A * 8/1989 Corbo ..... A47G 1/141 40/720
6,256,914 B1 7/2001 Yeh
(Continued)

FOREIGN PATENT DOCUMENTS

GB 1 452 954 10/1976

*Primary Examiner* — Gary C Hoge
(74) *Attorney, Agent, or Firm* — Leason Ellis LLP

(57) ABSTRACT

A display for displaying a plurality of images includes a cube shaped housing formed of a first housing part that includes first, second and third faces and a second housing part that includes fourth, fifth and sixth faces, wherein the first part and the second housing parts are coupled to one another by a snap-fit to form the cube shaped housing. The display includes a skeleton frame formed of a first frame part and a second frame part. The first frame part and the second frame part are attached to one another to surround the cube shaped housing. The display includes a first image template that includes interconnected first, second and third images, the first image being coupled to the first face, the second image being coupled to the second face and the third image being coupled to the third face. The display includes a second image template that includes interconnected fourth, fifth, and sixth images, the fourth image being coupled to the fourth face, the fifth image being coupled to the fifth face and the sixth image being coupled to the sixth face.

18 Claims, 9 Drawing Sheets

(56) References Cited

U.S. PATENT DOCUMENTS

| | | | | |
|---|---|---|---|---|
| 6,792,709 | B1 * | 9/2004 | Fine | A47G 1/0616 40/720 |
| 2002/0124451 | A1 * | 9/2002 | Ong | A47G 1/14 40/720 |
| 2002/0133994 | A1 * | 9/2002 | Vincent | A47G 1/14 40/720 |
| 2003/0192219 | A1 * | 10/2003 | Vincent | A47G 1/14 40/720 |
| 2007/0231515 | A1 * | 10/2007 | Yeom | A44C 15/00 428/34.1 |
| 2016/0296044 | A1 * | 10/2016 | Millman | A47G 1/0633 |
| 2018/0213950 | A1 * | 8/2018 | Millman | A47G 1/17 |

* cited by examiner

SECTION A-A

CUBE SHAPED DISPLAY ARTICLE

CROSS REFERENCE TO RELATED APPLICATION

The present application claims the benefit of and priority to U.S. patent application Ser. No. 62/927,497, filed Oct. 29, 2019, which is hereby incorporated by reference in its entirety.

TECHNICAL FIELD

The present invention is directed to a display article and in particular, to a cube shaped display article that is configured to display images (photos, artwork or the like) and can be used with any number of complementary accessories to allow the display article to be hung or stand on a surface.

BACKGROUND

There are many different ways to display articles, such as artistic works, photos, etc., with one of the more popular display articles being a frame in which the article to be displayed, such as a piece of art or photo, is placed. Frames come in many different sizes, shapes and colors. While frames typically have only one display face, there are displays that have cube shapes in order to provide multiple display faces, thereby allowing multiple articles, such as multiple photos, to be displayed. Often times, these cubes have transparent covers with the photos being placed behind the transparent covers.

SUMMARY

A display for displaying a plurality of images includes a cube shaped housing formed of a first housing part that includes first, second and third faces and a second housing part that includes fourth, fifth and sixth faces, wherein the first part and the second housing parts are coupled to one another by a snap-fit to form the cube shaped housing. The display includes a skeleton frame formed of a first frame part and a second frame part. The first frame part and the second frame part are attached to one another to surround the cube shaped housing. The display includes a first image template that includes interconnected first, second and third images, the first image being coupled to the first face, the second image being coupled to the second face and the third image being coupled to the third face. The display includes a second image template that includes interconnected fourth, fifth, and sixth images, the fourth image being coupled to the fourth face, the fifth image being coupled to the fifth face and the sixth image being coupled to the sixth face.

BRIEF DESCRIPTION OF THE DRAWING FIGURES

DETAILED DESCRIPTION OF CERTAIN EMBODIMENTS

Figure 1:
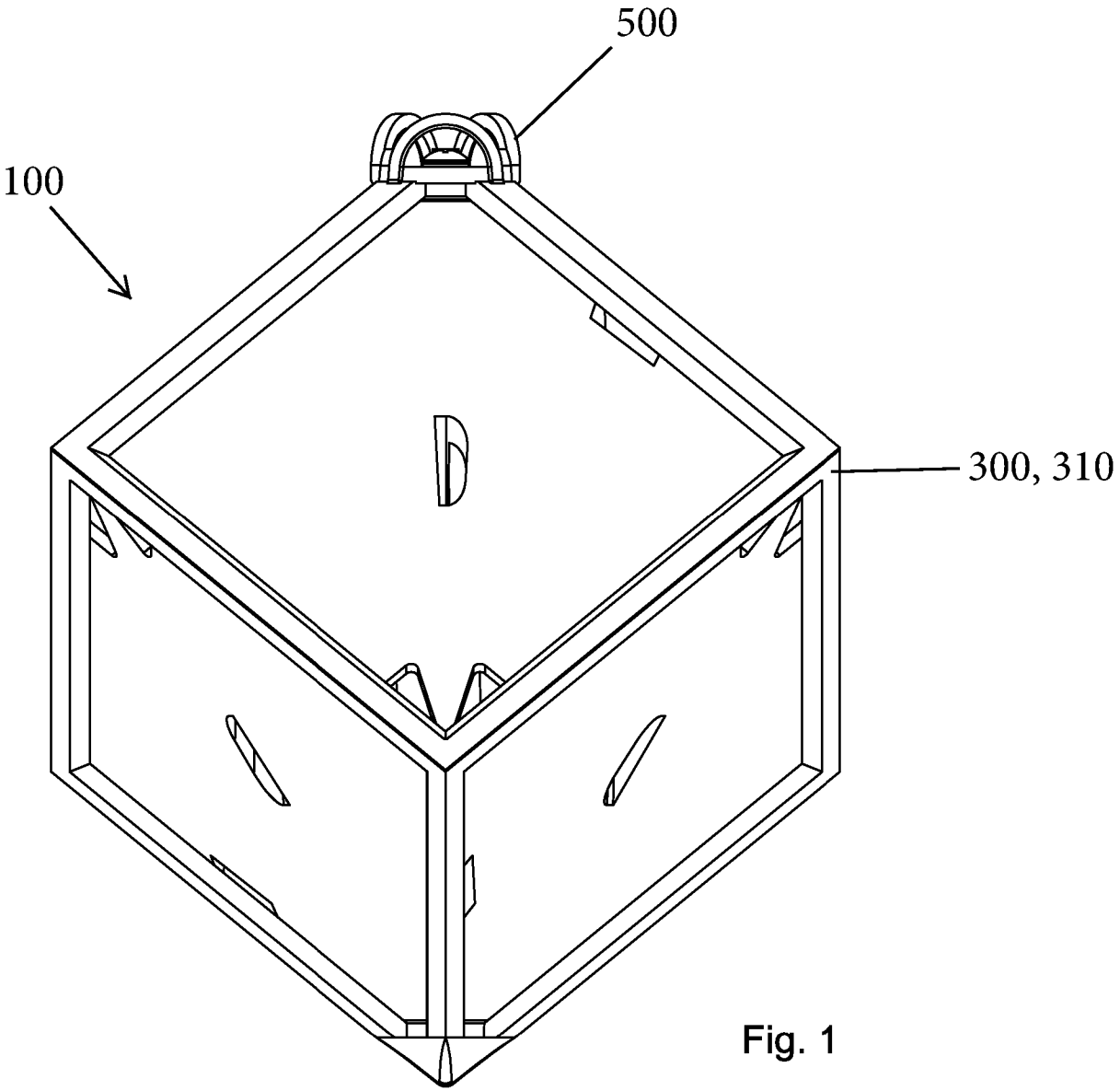
FIG. 1 is a side perspective view of a display article in an assembled state.

A display article 100 is generally shown in FIGS. 1-8 and in an assembled condition, the display article 100 has a cube shape defined by six display faces, namely, a first face, a second face, a third face, a fourth face, a fifth face, and a sixth face on which a discrete image (e.g., photo) can be displayed. As described herein, each of these faces is intended to display one article, such as one photo or one piece of artwork, etc.

In one aspect of the present invention, the display articles that are displayed on the display article 100 are generated from a stock template. The stock template is formed of a printable medium, such as a paper product and can be in the form of a label sheet (e.g., 8.5×11 inch sheet). As is known in FIG. 9, a label sheet typically includes two main layers, namely, a face stock 300 that represents the top layer of the label construction. An adhesive is adhered to the rear surface of the face stock 300. In one embodiment, the adhesive is a removable adhesive that allows the face stock 300 (labels) to be peeled off and reapplied. Such adhesives are of a low tack nature. The second layer of the label sheet (label construction) is a liner or back sheet which is the bottom layer of the label construction which is discarded after use. This is what the face stock 300 and adhesive sit on. The liner can be coated with silicone to enable the face stock 300 (label) to be pulled cleanly away from it.

In accordance with the present disclosure, the face stock 300 is precut so as to define two labels (two display articles), namely, a first label 310 and a second label 320. The first and second labels 310, 320 are surrounded by perimeter stock areas that are to be discarded. There are many different types of cuts that define and allow for separation and discrete removal of the first label 310 and the second label 320. For example, the first and second labels 310, 320 can be perforated. Another type of cut is a face perf that is a perforation that is only in the top layer of the label (face stock). The perforation stops when it hits the liner. Another type of cut is a face slit that is a slit that is only in the top layer of the label (face stock). The slit stops when it hits the liner.

In the illustrated embodiment, each of the first label 310 and the second label 320 has an L-shape. More specifically, the lengths of the two legs of the L are of the same or at least substantially the same. The first label 310 and the second label 320 provide the means for providing the articles to be displayed and thus each label 310, 320 is constituted by a plurality of articles to be displayed. For example, the first label 310 can be defined by a first article (e.g., first photo) 311, a second article 312 (e.g., second photo), and a third article 313 (e.g., third photo). Similarly, the second label 320 can be defined by a fourth article (e.g., fourth photo) 314, a fifth article 315 (e.g., fifth photo), and a sixth article 316 (e.g., sixth photo). It will be appreciated that each of the labels is intended for placement and securement to one of the faces of the cube by means of the removable adhesive (i.e., the labels are adhesively secured to the respective faces of the cube). As such, the L-shape of the label is defined by three blocks (squares) each of which represents one photo with one photo defining one leg of the label, another photo defining the other leg of the label and the third photo defining a corner.

As described below, the three articles (photos) that define the label are oriented differently from one another since the photos are folded over along seams between the photos to allow the photos to be adhesively secured to the respective faces of the cube. The labels 310, 320 and thus, the corresponding six articles (six photos) are thus designed to be peeled and stuck onto the cube frame as two discrete L-shaped labels and the removable nature of the adhesive allows for repositioning, if needed, of the labels 310, 320.

In addition, each of the labels 310, 320 can have a cut line 319, 323, respectively, formed therein and more specifically, the cut lines 319, 323 can be in the form of perforated cut lines. The three photos for one label 310, 320 intersect at one point (e.g., point 317 for the first label 310 and point 321 for the second label 320). The cut line 319 for the first label 310 has an arcuate shape and more specifically, has an arcuate shape that extends 270 degrees about the point 317 so as to dissect and perforate one corner of each of the three photos. In particular, the three corners of the three photos that meet at point 317 are perforated and removed. The removed material represents a 90 degree slice (corner) of the photo leaving a void in the photo at this corner. As shown, after the 90 degree corner has been removed, the remaining edge is a curved (concave shaped) edge since the corner material was removed from the label.

Due to the perforated cut lines 319, 323 being preformed in the sheet, the labels 310, 320 can be easily peeled from the liner and the material of the three corners meeting at points 317, 321 is left behind. As shown, when the label 310, 320 is folded and secured to the cube structure, the three missing corners define a triangular shaped void since when folded, each photo of the label 310, 320 is at a 90 degree angle to the other two photos. This triangular shaped void is positioned in one corner of the cube.

It will be understood that it is within the scope of this invention that one or both of the labels 310, 320 can be formed without the cut lines 319, 323, respectively, and thus, the corners are fully intact for the three photos.

While the term "photo" is used herein, this term is being used generally to represent a printed or transferred image that appears on the face stock and is intended to be displayed. For example, the photo (printed image) can be formed using any number of different technologies, including various printing processes, such as laser, inkjet, etc.

Figure 10:
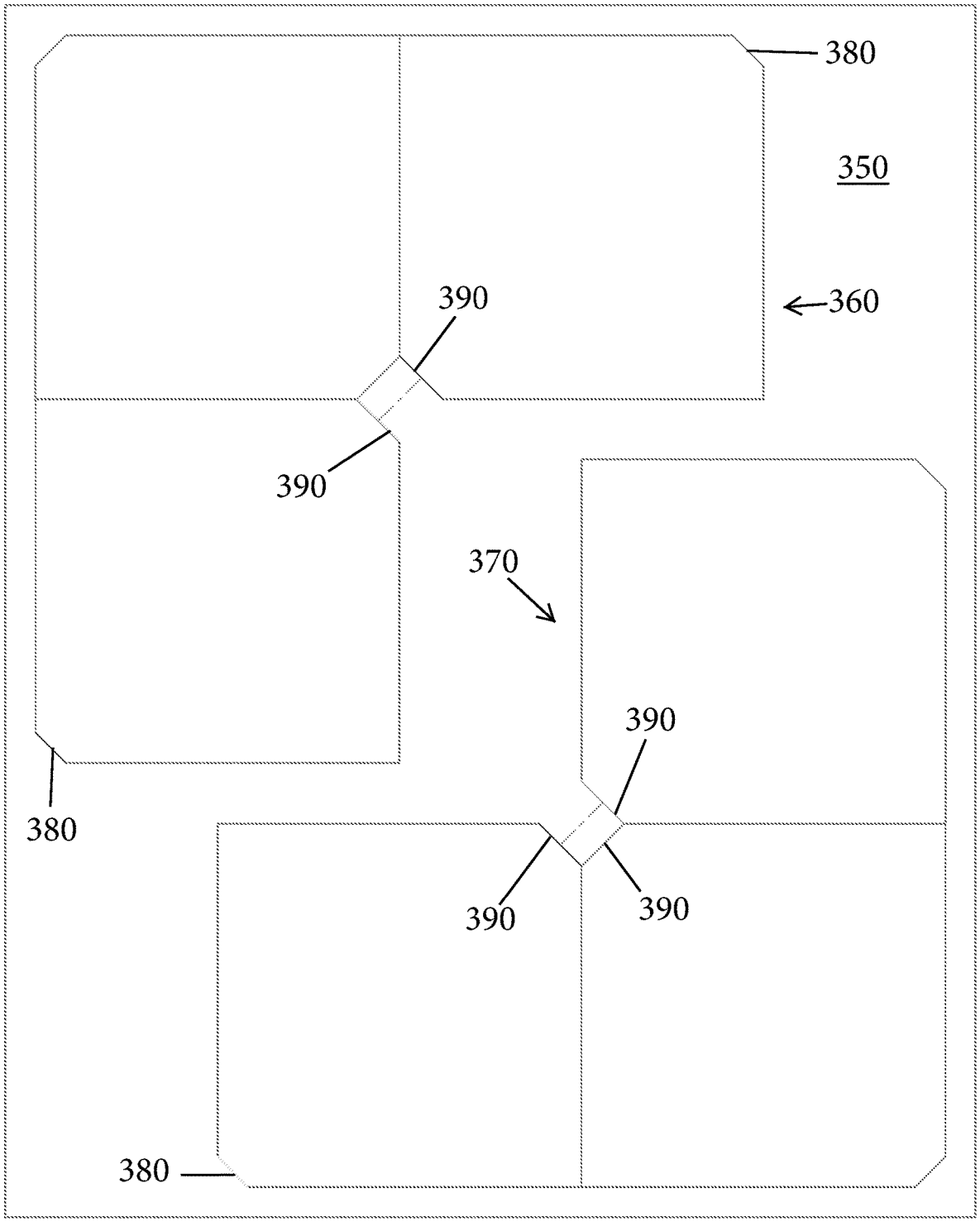
FIG. 10 illustrates a second image template.

FIG. 10 illustrates another embodiment of face stock 350. Within the face stock 350, there is a first label 360 and a second label 370. These labels can be similar to labels 310, 320 in that they each are generally L-shaped and defined by three blocks on which an image (photo) is placed, printed, transferred, formed, etc. Each block has an angled (cut) outer edge 380 and an angled (cut) inner edge 390. The inner edges 390 of the three blocks (photos) are oriented in common corners that are joined together and the linear nature of the cut inner edges 390 thus defines a square shaped opening when the label 360, 370 is removed from the liner.

Figure 9:
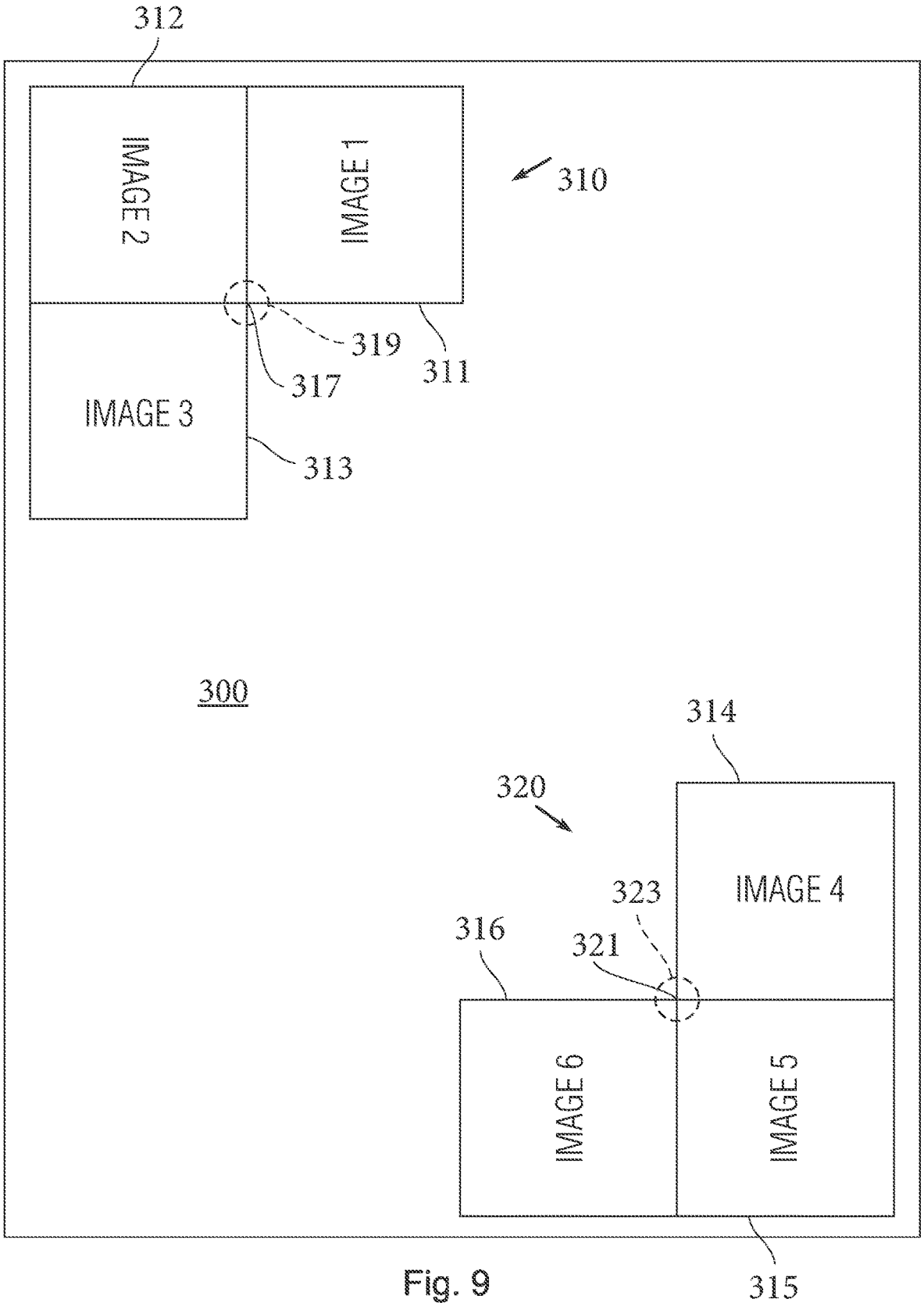
FIG. 9 illustrates a first image template.

In all other aspects, the sheets of FIGS. 9 and 10 can be the same or similar.

In both embodiments shown in FIGS. 9 and 10, the adhesive layer and the liner can be removed and instead the L-shaped labels are merely applied to the cube and held thereon using non-adhesive techniques described below.

Figure 2:
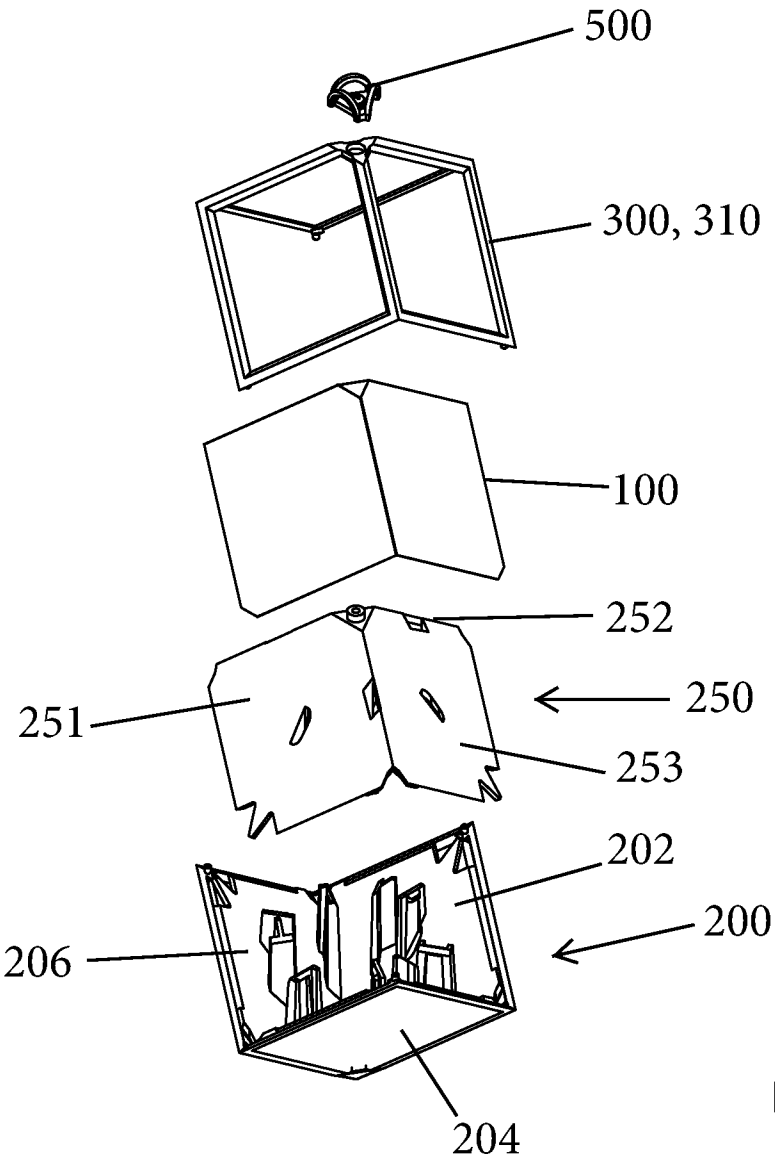
FIG. 2 is an exploded perspective view of the display article.
Figure 3:
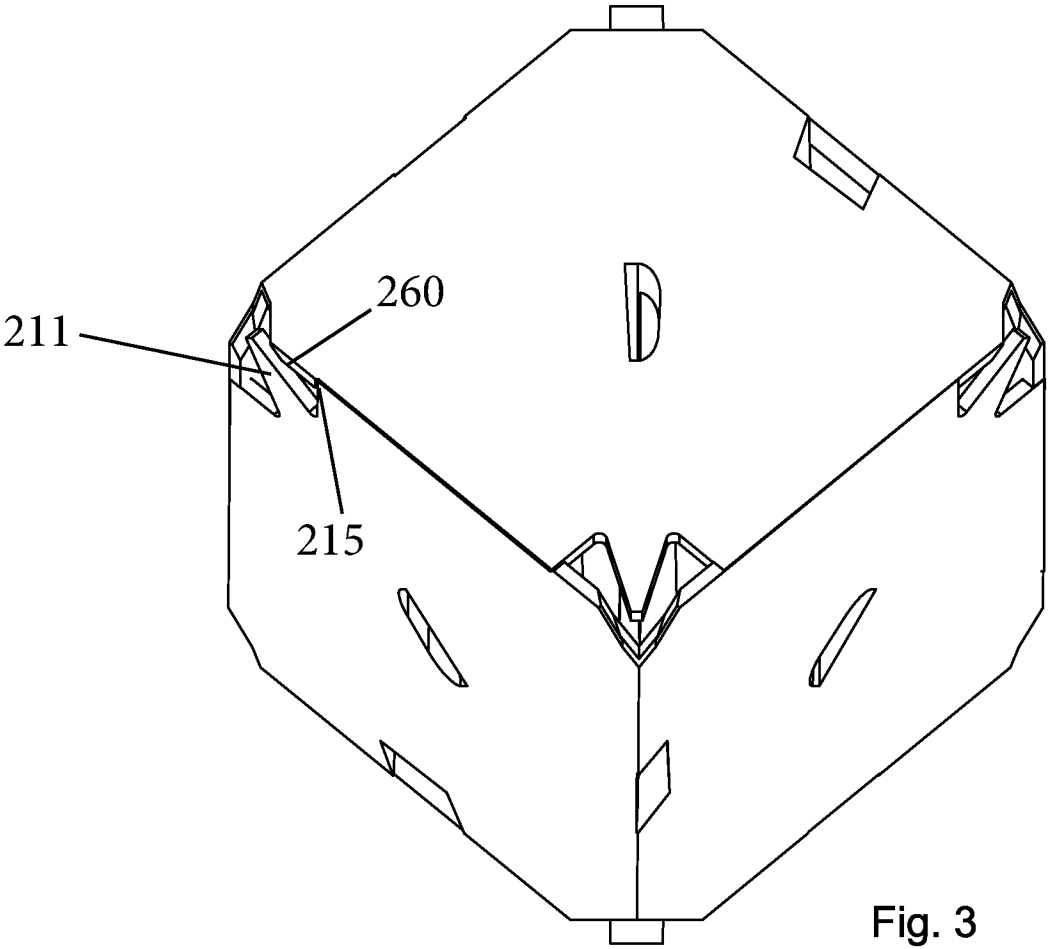
FIG. 3 is an exploded perspective of first and second backplates.
Figure 4:
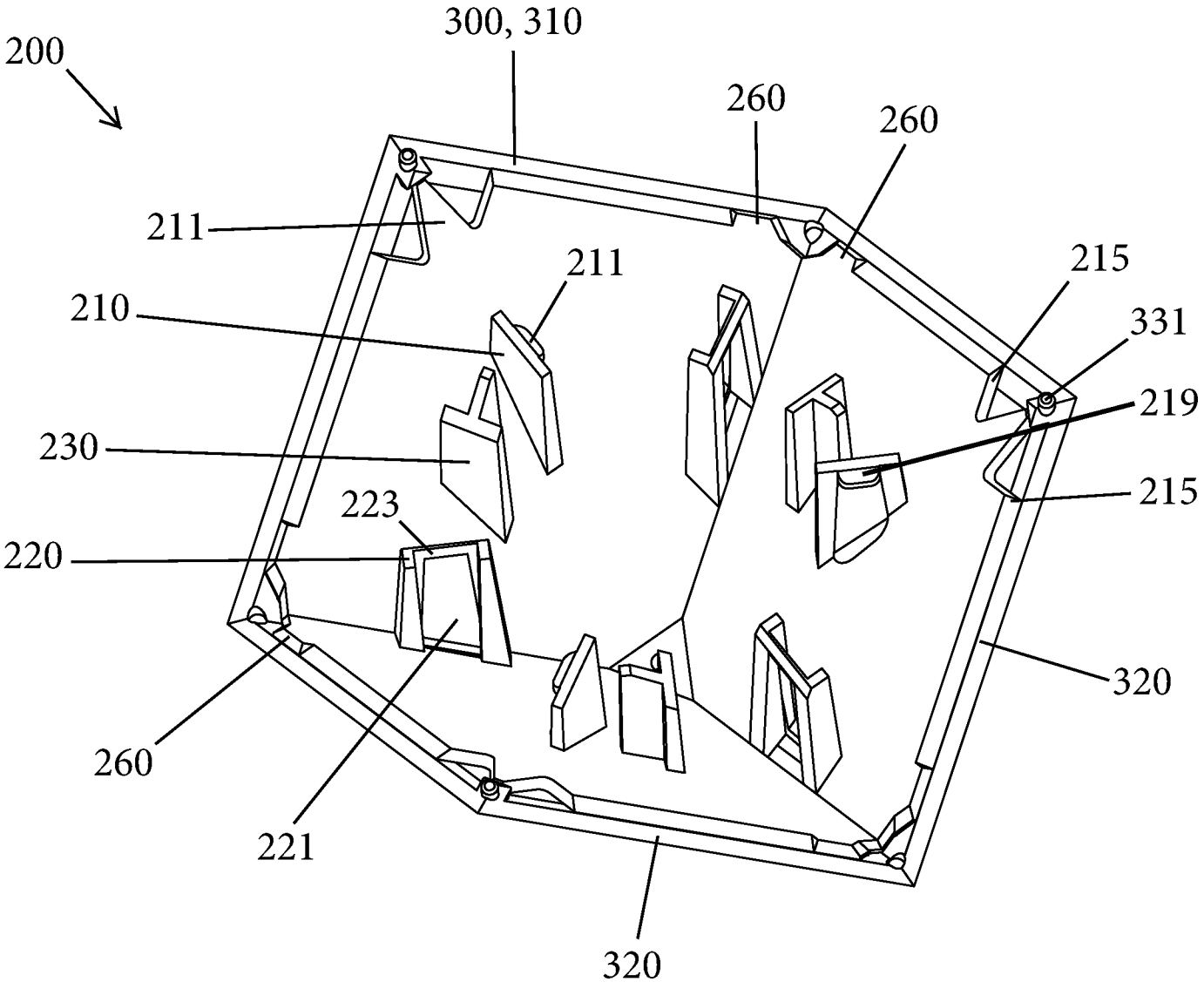
FIG. 4 is a perspective view of one backplate.
Figure 5:
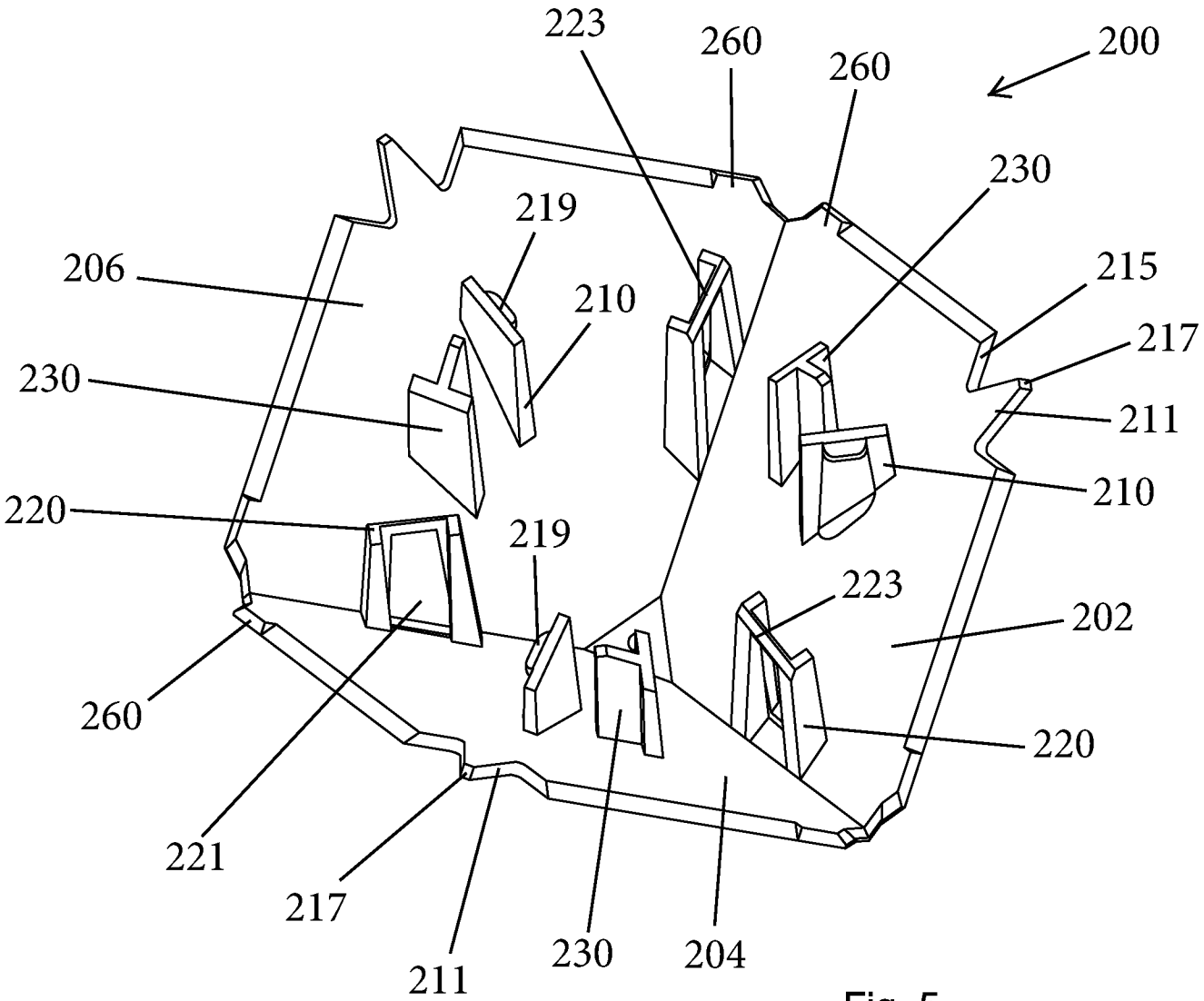
FIG. 5 is a perspective view of one backplate.
Figure 6:
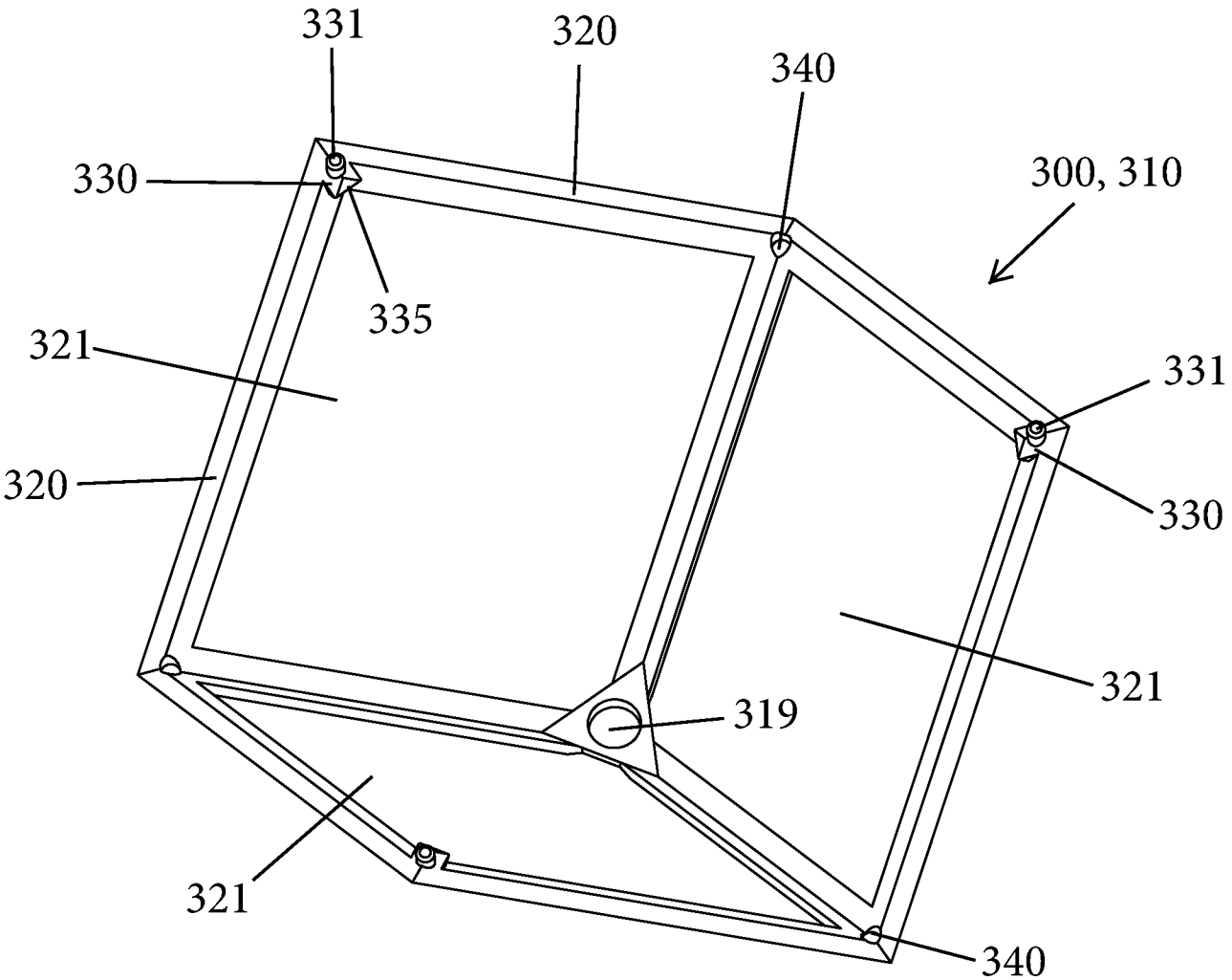
FIG. 6 is a perspective view of a skeleton frame.
Figure 8:
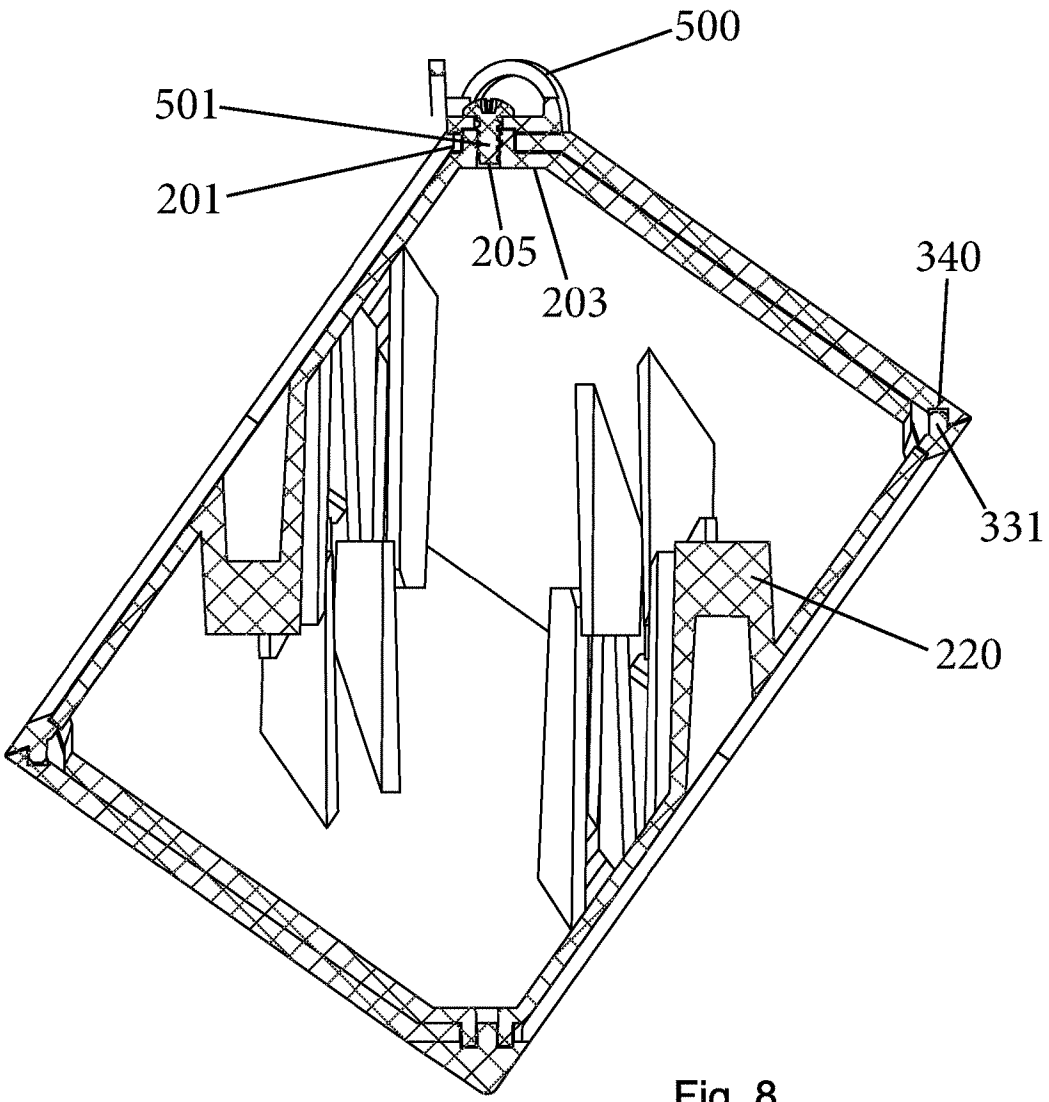
FIG. 8 is a cross-sectional view taken along the line A-A of FIG. 7.
Figure 7:
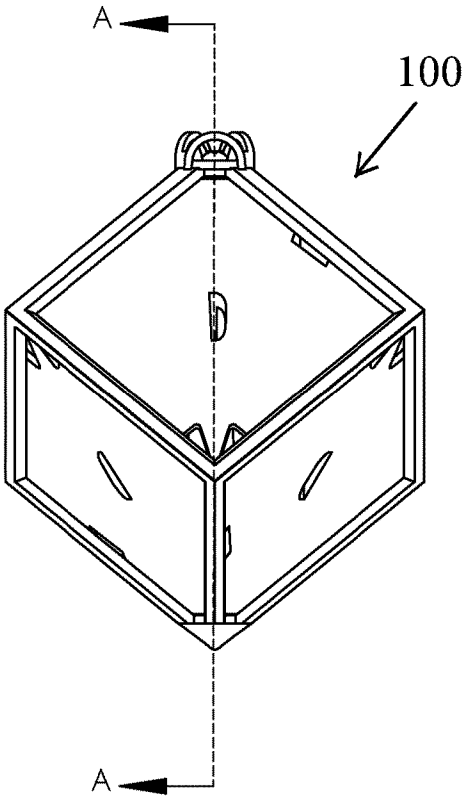
FIG. 7 is a perspective view of the display article.

The display article 100 is formed of a number of parts that are assembled together to define the illustrated cube structure on which the images (photos) are displayed. FIG. 2 is an exploded view showing the various parts. For example, the display article 100 can be formed of a first backplate 200 and a second backplate 250 with the two backplates 200, 250 being complementary to one another and being configured to be assembled to form the cube-shaped display article 100. The first backplate 200 is also configured to receive the first label 310, while the second backplate 250 is configured to receive the second label 320. Alternatively, as described herein, the two backplates 200, 250 receive discrete images that are not part of a label and not connected to one another and are displayed separate from one another.

The first and second backplates 200, 250 can have the same construction but be mirror images and complementary to one another to allow mating between the two backplates 200, 250.

Each of the first backplate 200 and the second backplate 250 comprises a three-sided structure in the form of ½ of a cube.

The first backplate 200 thus has a first wall 202, a second wall 204 and a third wall 206 that are joined to one another at right angles. Each of the first wall 202, second wall 204 and third wall 206 can thus be generally square shaped with the exception that one exposed corner of each of the walls 202, 204, 206 can include a flexible spring tab 211 the function of which is described below. The construction of each of the walls 202, 204, 206 can be the same. The distal end 217 of the flexible spring tab 211 has a flat surface (blunt end).

Similarly, the second backplate 250 has a fourth wall 251, a fifth wall 252 and a sixth wall 253 that are joined to one another at right angles. Each of the fourth wall 251, a fifth wall 252 and a sixth wall 253 can thus be generally square shaped with the exception that one exposed corner of each of the walls 251, 252, 253 can include one flexible spring tab 211. The construction of each of the walls 251, 252, 253 can be the same. When the first and second backplates 200, 250 are assembled, the first wall 202 can be positioned opposite the fourth wall 251; the second wall 204 can be positioned opposite the fifth wall 252; and the third wall 206 can be positioned opposite the sixth wall 253.

More specifically, each of the walls 202, 204, 206, 251, 252, 253 has the following features that are formed along the inner surface (inner face) of each wall: a male coupling member 210, a female coupling member 220 and a locator or guide 230.

The guide 230 can be in the form of a T-shaped protrusion that extends inwardly from the inner surface of the wall 202, 204, 206. As described herein, the guide 230 is configured to mate with the same type of guide 230 that is located on the opposite wall of the cube and is part of the second backplate 250. The guides 230 are intended to contact with one another to ensure that the desired snap-fit (described below) is achieved between the first and second backplates 200, 250. In other words, once the guides 230 align and mate properly, the subsequent snap-fit will occur without issue due to the proper alignment between the snap-fit parts.

The male coupling member 210 comprises a flexible post or elongated protrusion that extends inwardly from the inner surface of wall 202, 204, 206 and includes a locking tab (bump) 219 at or near the free distal end thereof. The female coupling member 220 comprises an elongated protrusion that extends inwardly from the inner surface of the wall 202, 204, 206 and includes a window 221 defined below a top wall 223. A snap-fit is formed between the male coupling member 210 and the female coupling member 220 by causing the locking tab 219 of the male coupling member 210 to be inserted into the window 221 as by sliding over the top wall 223 and into the window 223. Once the locking tab 219 flexes into the window 221, the male coupling member 210 of one wall 202, 204, 206 of the first backplate 200 is coupled to the opposing female coupling member 220 of the corresponding wall 251, 252, 253 of the second backplate 250. In this way, six separate snap-fit locations are formed to connect the first and second backplates 200, 250. The snap-fit can be of a permanent type or a reversible type.

It will be appreciated that other types of snap-fits can be used and even fasteners can be used instead of snap-fits to attach the two backplates.

The guides 230 are configured such that when the two backplates 200, 250 are assembled, the guides 230 of the first backplate 200 contact opposing guides 230 on the second backplate 250 before the corresponding male coupling members 210 mate with the female coupling members 220 to achieve the snap-fit between the two backplates 200, 250 by coupling the male coupling members 210 to the female coupling members 220.

One corner 201 of the first backplate 200 is not formed as a 90 degree corner but instead has a flat construction and is defined by a flat corner wall 203. As described herein, the corner 201 is intended to receive accessories that mount to the cube. As such, the flat corner wall 203 preferably has a coupling member to allow other objects to be coupled to this corner 201. For example, the coupling member can be in the form of a blind hole 205 or even a threaded hole that is used to the cube to other external accessories as described therein.

It will be appreciated that the multiple snap-fits between the two backplates 200, 250 prevent the separation of the backplates 200, 250 in one direction (i.e., prevents one backplate from being pulled apart from the other backplate). However, the snap-fits do not address any twisting action between the two backplates 200, 250. To address this type of motion, the exposed edges of each wall 202, 204, 206, 251, 252, 253 includes a raised structure 260 near one end of the edge. When assembled, the raised structures 260 abut a complementary structure to limit and prevent any twisting action between the two backplates 200, 250. This, along with the six snap-fits, ensure that the cube remains in its assembled condition. In particular, each spring tab 211 is formed in a corner defined by two exposed edges of the wall with each of the edges terminating in an end wall 215. The spring tab 211 is thus located between the two end walls 215. When the first and second backplates 200, 250 are assembled, the raised structures 260 abut against the end walls 215, thereby preventing twisting (rotation) of the two backplates 200, 250.

The illustrated openings and slots formed in the side walls of the cube are formed as part of the manufacturing process.

A frame skeleton is provided and in one aspect, is intended to hold photos or artwork in place along the sides of the cube and/or protect the images (photos). While in one embodiment, adhesive labels are used, it will be understood that loose photos or artwork can be used and the frame skeleton can be used to hold the photos in place as described herein. The frame skeleton can thus capture the images (photos/artwork) to be displayed and hold them against the cube.

Like the cube structure being formed of two parts, the frame skeleton can also be formed of two parts, namely, a first skeleton part 300 and a second skeleton part 310. These two skeleton parts 300, 310 mate together to work a skeleton or web around the cube and provide an outer frame for holding the photos or artwork. The two skeleton parts 300, 310 can be mirror images of one another and are designed to mate together.

Each skeleton part 300, 310 is formed of a number of interconnected rails 320 that define a center window 321 through which the photo or artwork is displayed. Each skeleton part 300, 310 has three sides. The rails 320 are disposed in front of the photo and serve to frame and hold the photo/artwork in place. The skeleton part 300, 310 includes a plurality of corner protrusions 330 and a plurality of holes 340 that receive corresponding corner protrusions 330 that are formed on opposite sides of the opposing skeleton part 300, 310. The exposed sides (ends) of the corner protrusion 330 act as stops to prevent or limit the movement of the skeleton on the cube since these exposed ends abut against edges (ends) of the cube side walls.

As shown, the protrusion 330 has a pin 331 protruding outwardly therefrom and a flat surface (face) 335 that faces inward toward the window 321. To secure the skeleton part 300 to the skeleton part 310, the pins 331 of one skeleton part are inserted into the openings 340 of the other skeleton part.

Each of the skeleton parts 300, 310 also can include a corner opening 319 that is formed through a triangular shaped wall formed in one corner of the skeleton part 300, 310. The corner opening 319 aligns with the blind or threaded hole 205 to allow attachment of an accessory to the cube that underlies the skeleton.

As mentioned, one aspect of the present display is that it can be easily accessorized. In particular, one or more accessories can be attached to the cube. In the figures, one type of accessory is shown. In particular, an accessory 500 is shown. The illustrated accessory 500 can be in the form of a hanging accessory that has looped rail structure defining a plurality of holes through which a hanging cord or cable can be passed through to allow handing of the display article 100. In this way, the display article 100 can be converted to a hangable ornament.

The accessory can also be in the form of a suction cup attachment or spinner attachment that allows the display article to sit and spin on a surface or a corner finisher can be provided that merely adds back a right angle corner to that corner of the cube.

As shown, the accessory 500 can be attached to the cube using a fastener 501 that passes through the accessory through the aligned openings 319, 205 and the threads of the fastener 501 bite into the side walls of the blind opening 205.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A display for displaying a plurality of images comprising:

a cube shaped housing formed of a first housing part that includes first, second and third faces and a second housing part that includes fourth, fifth and sixth faces, wherein the first part and the second housing parts are coupled to one another by a snap-fit to form the cube shaped housing;

a skeleton frame formed of a first frame part and a second frame part, the first frame part and the second frame part being attached to one another to surround the cube shaped housing;

a first image template that includes interconnected first, second and third images, the first image being coupled to the first face, the second image being coupled to the second face and the third image being coupled to the third face; and a second image template that includes interconnected fourth, fifth, and sixth images, the fourth image being coupled to the fourth face, the fifth image being coupled to the fifth face and the sixth image being coupled to the sixth face.

2. The display of claim 1, wherein the first image template and the second image template are formed of label stock with an adhesive backing layer for adhesively attaching the first image template to the first housing part and the second image template to the second housing part.

3. The display of claim 1, wherein each of the first image template and the second image template has an L-shape.

4. The display of claim 1, wherein the first frame part includes a plurality of female coupling members, a plurality of male coupling members and a plurality of guide members and wherein the second frame part includes a plurality of female coupling members, a plurality of male coupling members and a plurality of guide members, the female coupling members of the first frame part mates with the male coupling members of the second frame part.

5. The display of claim 4, wherein each of the first face, the second face, the third face, the fourth face, the fifth face and the sixth face includes one female coupling member, one male coupling member and one guide member.

6. The display of claim 5, wherein the one female coupling member, the one male coupling member and the one guide member protrude inwardly from the respective face.

7. The display of claim 1, wherein each of the first face, the second face, the third face, the fourth face, the fifth face, and the sixth face includes an integral spring tab that is located in a corner.

8. The display of claim 7, wherein the integral spring tab has a triangular shape.

9. The display of claim 1, wherein each of the first face, the second face, the third face, the fourth face, the fifth face, and the sixth face includes a raised structure that abuts a complementary surface when the first and second housing parts are assembled with one another, the raised structures being configured to limit and prevent any twisting action between the first and second housing parts.

10. The display of claim 1, wherein each of the first frame part and the second frame part includes a plurality of corner protrusions and a plurality of holes that receive corresponding corner protrusions that are formed on opposite sides of the opposing the first frame part and the second frame part.

11. The display of claim 10, wherein the corner protrusion comprises a pin.

12. The display of claim 1, wherein the first housing part has a truncated corner with a protrusion extending outwardly therefrom and received within a corner hole formed in the first frame part that overlies the first housing part.

13. The display of claim 12, further including an accessory that is attached to the truncated corner of the first housing part.

14. The display of claim 1, wherein the first image template includes an arcuate shaped first cut line that is located in a corner at which the first image, the second image and the third image intersect one another and the second image template includes an arcuate shaped second cut line that is located in a corner at which the fourth image, the fifth image and the sixth image intersect one another.

15. The display of claim 1, wherein each of the first frame part and the second fame part is formed of a plurality of interconnected rails that define three square shaped walls with center openings through which the respective first image, second image, third image, fourth image, fifth image and sixth image are visible.

16. The display of claim 1, wherein an outer edge of each of the first image, the second image, the third image, the fourth image, the fifth image and the sixth image is truncated and wherein an opposite inner edge of each of the first image, the second image, the third image, the fourth image, the fifth image and the sixth image is truncated.

17. The display of claim 16, wherein the truncated inner edges of the first image and the third image are parallel to one another and the truncated inner edges of the fourth image and the sixth image are parallel to one another.

18. A display for displaying a plurality of images comprising:

a cube shaped housing formed of a first housing part that includes first, second and third faces and a second housing part that includes fourth, fifth and sixth faces, wherein the first part and the second housing parts are coupled to one another by a snap-fit to form the cube shaped housing, the first housing part having a first truncated corner and the second housing part having a second truncated corner;

a skeleton frame formed of a first frame part and a second frame part, the first frame part and the second frame part being attached to one another to surround the cube shaped housing;

a first image template that includes interconnected first, second and third images, the first image being coupled to the first face, the second image being coupled to the second face and the third image being coupled to the third face; and a second image template that includes interconnected fourth, fifth, and sixth images, the fourth image being coupled to the fourth face, the fifth image being coupled to the fifth face and the sixth image being coupled to the sixth face;

wherein each of the first frame part and the second fame part is formed of a plurality of interconnected rails that define three square shaped walls with center openings through which the respective first image, second image, third image, fourth image, fifth image and sixth image are visible.

* * * * *